United States Patent [19]

Kowalick et al.

[11] 3,968,724

[45] July 13, 1976

[54] METHOD FOR ACCURATELY VARYING THE DENSITY OF A POWDER OR POWDER CHARGE, AND SHRINK TUBES FOR USE THEREWITH

[75] Inventors: James F. Kowalick, Southampton; George F. Hare, Feasterville, both of Pa.; Harry J. Addison, Jr., Willingboro, N.J.

[73] Assignee: The United States of America as represented by the Secretary of the Army, Washington, D.C.

[22] Filed: Oct. 3, 1974

[21] Appl. No.: 511,830

[52] U.S. Cl. ..... 86/20 R; 102/70 R; 102/27 R; 102/24 R

[51] Int. Cl.[2] ..... F42B 3/00; C06B 21/00

[58] Field of Search ..... 102/24 R, 27 R, 70 R; 156/86; 86/20 R

[56] References Cited

UNITED STATES PATENTS

| | | | |
|---|---|---|---|
| 3,665,858 | 5/1972 | Travor | 102/27 |
| 3,717,096 | 2/1973 | Ward | 102/28 M |
| 3,731,625 | 5/1973 | Slawinski | 102/24 |
| 3,789,761 | 2/1974 | Travor | 102/27 |

FOREIGN PATENTS OR APPLICATIONS

| | | | |
|---|---|---|---|
| 1,186,331 | 4/1970 | United Kingdom | 102/24 |

OTHER PUBLICATIONS

Dept. of the Army Tech. Man. TM 9–1910, Military Explosives, Apr. 1955, (pp. 118 and 119).

*Primary Examiner*—Verlin R. Pendegrass
*Attorney, Agent, or Firm*—Nathan Edelberg; Robert P. Gibson; Kalman Pollen

[57] ABSTRACT

Plastic shrink tubes, when filled loosely with explosive powders, and sealed and heated to temperatures of about 300° – 600°F, will shrink and uniformly compress the powders contained therewithin along the length thereof to produce a powder of constant linear density useful in providing constant velocity detonations.

2 Claims, No Drawings

METHOD FOR ACCURATELY VARYING THE DENSITY OF A POWDER OR POWDER CHARGE, AND SHRINK TUBES FOR USE THEREWITH

The invention described herein may be manufactured, used and licensed by or for the Government for governmental purposes without the payment to me of any royalty thereon.

Our invention relates to explosive powders and more particularly concerns means for providing constant powder densities over predetermined lengths contained within shrink tubing.

The advantages of providing a powder of constant linear density are many. For example, in explosive welding applications of the past, variable velocities of detonation resulted in some portions of the metal surfaces to be bonded together remaining unbonded. Through the practice of our invention complete adhesion of the metals to be bonded results.

Further, workpieces in the past frequently suffered from weakening or failure in free-forming operations because the explosive powder used in their formation often times generated some undesirably high detonation pressures and velocities of detonation. In other cases the workpiece was unevenly formed because of greater or less charge concentration due to density variation with length. Such undesirable results are substantially eliminated through the practice of our invention.

Our method provides still additional advantages when forming a cavity in the earth by blasting techniques. For example, more complete control of the size and shape of the crater may now be achieved because of the constant linear density of the powder which results in a constant velocity of detonation.

While the instant method may be advantageously applied to the formation of an explosive powder to constant linear density, the method may also be applied to the formation of any powder to constant linear density, such as pyrotechnic powders, filtration powders, and the like.

The net result of our invention is an explosive powder whose linear loading in mass per unit length is so accurately controlled that a linear density variation of less than 2% is discernible. Linear loading may be defined by Equation (1).

$$\text{Eq. (1)}\quad L = \rho A$$

where L represents linear loading; $\rho$, the density of the powdered explosive; and A, the cross-sectional area of the tubing containing the powdered charge.

In other applications where it is desired to pack the powder quite densely, two concentric pieces of tubing may be employed to further increase compressive forces on the powder contained therein. Still other applications may require a given constant velocity over a first interval, with a different velocity over a second interval. This may be readily accomplished by linearly varying the initial density of the powder placed in the tubing, or by linearly varying the thickness of the tubing. Yet other applications may require that the cross-section of the tubing vary in size and shape with length, or that the cross section of the tubing be square, elliptical, rectangular or irregular. Our method is readily applicable to all such configurations.

High explosive powders may be used wherever a high rate of energy input is required, such as when fragmenting a round of ammunition, blasting rock formations, opening trenches or cavities in the earth's surface, generating a shaped charge jet, propelling material into a die to effect a given shape, free-forming material by explosive means, or in effecting explosive bonding operations where two materials are formed and bonded into one composite piece, and in practicing a host of other applications.

In each of the above applications, the quality of the final product depends substantially on the impulse and the detonation velocity of the explosive. An explosive impulse has two characteristics of high importance, i.e. detonation pressure and pulse width. Detonation pressure, $P_D$ may be described as $$P_D \alpha \rho D^2$$

where $\rho$ represents the density of the powdered explosive and D represents the detonation velocity. The pulse width depends on the reaction kinetics of the explosive, its quantity and confinement, and the shape of the detonation wavefront.

Prior art, commercially used, high explosives are not readily packed to a constant density. Their resulting velocities of detonation are thus variable and erratic results may follow. One means used in the past by which velocities of detonation have been modified but not maintained at a fixed value has been through the application of additives to the explosives, which method has met with limited success over the past 20 years. Another technique employed in varying the detonation velocity of an explosive has been to control the bulk density of the explosive which may be accomplished by well-known means. It should be borne in mind that velocity of detonation varies directly with the density of the powdered explosive charge. This latter technique may be used most effectively if the density of the explosive can be readily and precisely controlled. Slight changes in the density of the powder due to loading process variations can result in accompanying changes in velocity of detonation, and hence significant changes in the final velocity of detonation.

In U.S. Pat. No. 2,982,210, a metallic or lead sheath is used to surround a high explosive which could then be pressed under hydraulic pressure to a constant maximum density. The instant invention, however, employs shrink tubes whose thermal reduction and inherent elasticity provides and maintains the compressive force; no undesirable metallic debris results upon detonation, and a wide and convenient range of densities may be effected with the process.

It is thus a broad object of this invention to provide means for packing powders to an uniform density.

It is a further object of the invention to provide an uniform detonation velocity of explosives by controlling the densities thereof.

Another object of the invention is to provide a broad range of selected, precise, and constant velocities of detonation with a given explosive.

These and other objects will be apparent from the following description.

Briefly, our invention provides for the use of one or only a few high explosives to accomplish the above-mentioned tasks, by varying and controlling the densities of the powdered explosives. These explosives include, but are not limited to nitroguanidine, PETN (pentaerythritol tetranitrate), RDX (cyclotrimethylene trinitramine), HMX (cyclotrimethylene tetranitramine), DIPAM (dipicramide), HNS (hexanitrostilbene), free-flowing dynamite, ammonium nitrate, and TNT (trinitrotoluene). Our invention further provides for the use of these explosives at velocities of detonation considerably lower than their respective maximum velocities of detonation. For example, velocities as low as 1,000 m/sec have been readily obtained through the practice of our invention.

More specifically, by the methods of our invention, powdered high explosive materials or mixtures thereof may be formed and packaged into charges having constant linear densities, producing constant velocities of detonation with very little variation in the resultant detonation velocity over a considerable distance. These results have been accomplished through the use of a container comprising one of many available types of "shrink" plastic tubing, which tubing upon heating to a temperature ranging between about 300° to 600°F, reduces in size to a predetermined value (non-filled value).

Such shrink tubing has been previously used for such applications as thermally or electrically insulating tubular or irregular shaped objects, putting grips on devices such as handles, or joining two pipes with the tubing, and the like. Any chemically compatible tubing upon heating thereof which will shrink and so compress the powder therein uniformly to a constant density has been found suitable for practicing my invention and may be referred to as "shrink" tubing. We have found, however, that either polyethylene tubing or Teflon (polytetrafluoroethylene) shrink tubing may be used most advantageously in accordance with our invention. Normally, a maximum heating period of 10–15 minutes at about 300°–600°F will effect maximum shrinkage. Occasionally, at high bulk densities of the powder charge, the tubing will not shrink to its minimum rated value because the compressive force of the shrinking tube is resisted by the elastic force of the powdered material contained therewithin and being compressed. Above a fixed minimum bulk powder density, the greater the initial bulk density of the powder the less the resulting shrinkage of the tubing. The resultant powder will have a constant linear density, which varies however, somewhat radially, but does so in a regular manner along the length of the shrink tubing so as not to affect or cause deviations from the constant velocity of detonation axially. Linear density may be described as the density profile of all powder taken along a direction parallel to the tube axis, at any point of which the density value $\rho_L$ may be calculated from the equation $$\text{Eq. (2)}\quad \rho_L = \frac{\sum \rho_i A_i}{A}$$

where $\rho_L$ is the linear density in mss/length$^3$, and $\rho_i$ is the density (in mass/length$^3$) of the powder occupying an areal increment $A_i$ of the total tube area A.

Several illustrative examples of providing an explosive powder of constant linear density are set out below. Upon initiation these powder charges will produce a constant velocity of detonation. In the examples below the velocities of detonation were measured using the known ionized probe method which comprises broadly placing several pairs of conducting wires within an explosive charge at predetermined intervals therealong, the conducting wires being attached to suitable electronic recording devices, there being a gap or open circuit across the explosive charge between each of the two wires comprising each conducting wire pair. The detonation front completes the open circuits across the explosive charge and so enables measurement of the velocity of detonation of the explosive charge. Constant linear densities of the resulting powders formed according to our method were measured by cutting small segments therefrom and weighing. In Table I below three sets of values designated A, B, and C, are listed for the inside diameter (ID) and outside diameter (OD) of Teflon Shrink tubing before and after heating for a maximum of 5 minutes at about 350°F, the ID and OD after heating being referred to as the recovered ID and the recovered OD. The thickness of the walls of the tubing was 0.02 inch in tubing types A and B, and 0.025 inch in tubing type C. The thickness of the tubing wall did not appreciably vary during the heating process.

TABLE I

| | Shrink Teflon Tubing, (in.) | | |
|---|---|---|---|
| Type | Nominal ID | Actual ID/Recovered ID | Recovered OD |
| A | 7/16 | .580/.448 | .488 |
| B | 1/2 | .666/.510 | .550 |
| C | 5/8 | .830/.637 | .687 |

EXAMPLE I

The Preparation of Powdered Nitroguanidine To A Constant Linear Density and A Bulk Density of 0.4 g/cc It is desired to have an 8 inch plastic tube loaded for 6 inches with nitroguanidine, a high explosive, at a bulk density of 0.4 g/cc (6.52 gm/in$^3$) and with an approximate linear loading of 1.25 gm/in., linear loading being defined by Equation (1). The respective linear loadings, calculated by multiplying the desired bulk density, 0.4, by the cross sectional area of each of the three recovered ID values listed in Table I, are 1.22 gm/in., 1.55 gm/in., and 2.42 gm/in.. Since the 1.22 value is closest to the desired value of 1.25, this value is chosen and Type A tubing is employed. An eight inch length type A tube (with one-inch stoppers in each end making the loadable length six inches) is filled with 1.22 gm/in. × 6 inches or 7.32 gm. The tubing is heated at about 350°F (slowly rotated concurrently therewith by any suitable means) for about 5 minutes using an electric resistance blower until shrinkage to the final 0.448 inch ID(.488 inch OD, including two 0.020 inch tubing walls) is attained. The resulting compacted nitroguanidine has a constant linear density, and an average density of 0.4 g/cc.

EXAMPLE II

Determination of Linear Loading For A Desired Velocity Of Detonation And A Given Cross-Sectional Area It is desired to provide a cylindrical explosive charge having a detonation velocity of 3,500 meters per second and an OD of approximately 0.68 inches for purposes of explosively welding a thin tube, having an ID of approximately 0.68 inches, into a thick steel cylinder. The initial task is to determine the required linear loading.

Because nitroguanidine is commonly used for explosive welding and will detonate over a wide range of densities, it has been selected for this application. For most powdered explosives, the relationship between velocity of detonation and density is linear, and is provided by the following equation:

$$\text{Eq. (2)}\quad V = a + b\rho$$

where V represents velocity of detonation; $a$ and $b$ are constants for a given explosive; and $\rho$ represents the density of the explosive powder. For nitroguanidine $a$ and $b$ are 1445 meter/sec and 4015 meter × cc/gm × sec respectively. Then $V = 1445 + 4015\ \rho$ (in meters/sec) and when V is equal to 3,500 meters/sec., $\rho$ then is equal to 0.512 gm/cm³, or 8.34 gm/in³. Type C tubing, Table I, having a final recovered outside diameter (OD) of 0.687 inch is thus selected. Since the after-shrink ID is 0.637 inch (Table I) the cross-sectional area of the tubing will be $$\frac{\pi(.637)^2}{4}$$

or 0.318 square inches. The required linear loading, $L = \rho A$ will be $L = (8.34)(.318)$ or 2.65 gms/inch.

EXAMPLE III

Preparation of Powdered RDX to A Constant Linear Density And A Bulk Density of 0.5 gm/cc It is desired to have a plastic tube loaded with RDX, at a bulk density of 0.5 g/cc (8.15 g/in³) and with an approximate linear loading of 2.6 gm/inch. The length of loaded tubing desired is 10 inches. Using Table I, it is determined that, of the three choices of tubing sizes, Type C having a recovered ID of 0.637 inches, will be suitable, since the linear loading L is 2.59 gm/inch with this tube, a value calculated from Eq. 1. Then a loose charge of 2.59 g/inch × 10 inches or 25.9 grams, is loaded into a twelve-inch, Type C tube (with one-inch stoppers in each end, making the loadable length ten inches). The tubing is heated at about 350°F (slowly rotated concurrently therewith by any suitable means) for about 5 minutes with an electric resistance blower until shrinkage occurs to the final 0.637 inch ID (0.687 inch OD).

We claim:

1. Method for controlling the density of an explosive powder and bringing said powder to a desired constant linear density powder charge comprising:

a. inserting said explosive powder into heat shrink tubing, said heat shrink tubing comprising a plurality of concentric pieces of heat shrink tubing, b. sealing ends of said powder contained heat shrink tubing, and c. heating said sealed heat shrink tubing to effect shrinkage of said tubing and radial compression of said explosive powder contained therewithin to a constant linear density powder charge.

2. Method for effecting a constant velocity of detonation of an explosive powder over a first interval with a different velocity over a second interval comprising:

a. inserting said explosive powder of a first density into heat shrink tubing, and inserting powder of a second density into remainder of said tubing, b. sealing ends of said powder contained heat shrink tubing, c. heating said sealed shrink tubing to effect shrinkage of said tubing and radial compression of said explosive powder contained therewithin, d. initiating said heat shrunk shrink tubing.

* * * * *